US006726160B1

(12) United States Patent
Buchanan, Jr.

(10) Patent No.: US 6,726,160 B1
(45) Date of Patent: Apr. 27, 2004

(54) ADJUSTABLE BOW STAND

(76) Inventor: Duncan R. Buchanan, Jr., 84 Keystone Rd., Reading, PA (US) 19606

( * ) Notice: Subject to any disclaimer, the term of this patent is extended or adjusted under 35 U.S.C. 154(b) by 0 days.

(21) Appl. No.: 10/445,439

(22) Filed: May 28, 2003

(51) Int. Cl.[7] ..... A45F 3/44

(52) U.S. Cl. ..... 248/156; 248/309.1; 248/165; 248/170; 248/545; 248/127; 124/86; 124/23.1

(58) Field of Search ..... 248/176.1, 149, 248/150, 165, 166, 354.5, 156, 170, 545, 688, 126, 127, 188.6, 440.1, 309.1, 463; 124/86, 23.1

(56) References Cited

U.S. PATENT DOCUMENTS 2,584,713 A * 2/1952 Kanaval ..... 248/121
3,441,241 A * 4/1969 Brooks ..... 248/156
5,111,800 A * 5/1992 Reynolds ..... 124/88
5,626,379 A * 5/1997 Scott ..... 294/143
6,205,992 B1 * 3/2001 Meeks et al. ..... 124/86

* cited by examiner

*Primary Examiner*—Kimberly Wood

(57) ABSTRACT

Adjustable bow stands providing a hunter with cover and easy access to his or her weapon. A shaft has a fork attached to one end and a shaft clip removably attached to its opposing end. The shaft clip attaches a bow holder to the shaft. The bow holder can be adjusted to hold a bow at a variety of angles, and the shaft clip can be adjusted to hold a bow at a variety of heights. A rear leg with a rear leg support attached to one end can be unfolded from the shaft. The length of the rear leg is adjusted by a telescoping mechanism. A cap covering the opposing end of the shaft removably covers a screwdriver compartment holding a screwdriver. The screwdriver fits a screw in the bow holder to facilitate the adjustment of the bow holder. Natural or artificial tree limbs can be inserted into limb holders attached to the front of the fork.

20 Claims, 5 Drawing Sheets

ADJUSTABLE BOW STAND

BACKGROUND OF THE INVENTION

1. Field of the Invention

The present invention relates to an adjustable bow stand for use in connection with hunting. The adjustable bow stand has particular utility in connection with providing a hunter with cover and easy access to his or her weapon.

2. Description of the Prior Art

Adjustable bow stands are desirable for providing a hunter with cover and easy access to his or her weapon. Most bow hunters use a tree stand because it makes it harder for a game animal to see or smell them. Unfortunately, some people are unable to climb a tree to use a tree stand. Furthermore, the terrain in the area where an individual wishes to hunt may make it difficult or impossible to use a tree stand. Adjustable bow stands overcome these difficulties by allowing hunters to easily construct a ground blind in the spot where they wish to hunt. Furthermore, the adjustable bow stand keeps the hunter's weapon close at hand so that the hunter can easily raise it into shooting position with very little noise or excess movement to startle the game animal.

The use of adjustable stands for archery bows is known in the prior art. For example, U.S. Pat. No. 6,205,992 to Meeks et al. discloses an adjustable stand for an archery bow. However, the Meeks et al. '992 patent does not have a screwdriver, and has further drawbacks of lacking a limb holder.

U.S. Pat. No. 5,106,044 to Regard, III et al. discloses a portable compound bow stand that supports a compound bow in a substantially vertical position relative to the ground. However, the Regard, III et al. '044 patent does not have a screwdriver, and additionally does not have a limb holder.

Similarly, U.S. Pat. No. 5,547,162 to Sobolewski et al. discloses a archery bow stand that enables a bow to stand in a vertical position in relation to the ground. However, the Sobolewski et al. '162 patent does not have a screwdriver, and cannot hold a tree limb.

In addition, U.S. Pat. No. 5,628,300 to Wallendorf discloses a archery bow sighting and tuning apparatus that is attached to an archery bow for sighting and tuning the bow. However, the Wallendorf '300 patent does not have a screwdriver, and also does not have a limb holder.

Lastly, U.S. Pat. No. Des. 406,302 to Simpson et al. discloses a bow stand that holds a bow in a substantially vertical position relative to the ground. However, the Simpson et al. '302 patent does not have a screwdriver, and further lacks a limb holder.

While the above-described devices fulfill their respective, particular objectives and requirements, the aforementioned patents do not describe an adjustable bow stand that allows providing a hunter with cover and easy access to his or her weapon. The above patents make no provision for a screwdriver and further lack a limb holder.

Therefore, a need exists for a new and improved adjustable bow stand that can be used for providing a hunter with cover and easy access to his or her weapon. In this regard, the present invention substantially fulfills this need. In this respect, the adjustable bow stand according to the present invention substantially departs from the conventional concepts and designs of the prior art, and in doing so provides an apparatus primarily developed for the purpose of providing a hunter with cover and easy access to his or her weapon.

SUMMARY OF THE INVENTION

In view of the foregoing disadvantages inherent in the known types of adjustable stands for archery bows now present in the prior art, the present invention provides an improved adjustable bow stand, and overcomes the above-mentioned disadvantages and drawbacks of the prior art. As such, the general purpose of the present invention, which will be described subsequently in greater detail, is to provide a new and improved adjustable bow stand which has all the advantages of the prior art mentioned heretofore and many novel features that result in an adjustable bow stand which is not anticipated, rendered obvious, suggested, or even implied by the prior art, either alone or in any combination thereof.

To attain this, the present invention essentially comprises a fork with one end of a shaft attached to its top. A shaft clip is removably attached to the opposing end of the shaft. A bow holder has one end hingedly attached to one of the ends of the shaft clip. A hinge bracket has one end connected to the middle of the shaft and a hinge pin inserted through its opposing end. A rear leg has one end connected to the opposing end of the hinge bracket by the hinge pin. The opposing ends of a folding brace connect the middle of the shaft to the middle of the rear leg.

There has thus been outlined, rather broadly, the more important features of the invention in order that the detailed description thereof that follows may be better understood and in order that the present contribution to the art may be better appreciated.

The invention may also include a limb holder attached to the fork's front. The opposing end of the shaft may define a screwdriver compartment in the form of a hole with a cap removably covering it. There may be a screwdriver removably inserted into the screwdriver compartment. There may be a rear leg support with its middle attached to the opposing end of the rear leg. The rear leg may be telescoping in nature. The bottom of the fork may be adapted to be driven into the ground. The bow holder may be adapted to fit a compound bow. The adjustable bow stand may be made of plastic, steel, aluminum, titanium, wood, or carbon fiber composite. There may be a limb with one end removably inserted into the limb holder. The limb may be a natural tree limb or an artificial tree limb. The fork may have a fork head with its top attached to one end of the shaft and a plurality of fork tines attached to its bottom. There may be a plurality of limb holders attached to the front of the fork head. The middle of the shaft clip may be removably attached to the opposing end of the shaft. There may be a bolt with one end inserted through one end of the shaft clip and a wing nut threadedly attached to the bolt's end. The bow holder may have one end pivotably attached to the opposing end of the shaft clip. A bolt may have one end inserted through the opposing end of the shaft clip and the end of the bow holder. There may be a wing nut threadedly attached to the end of the bolt. The bow holder may comprise a plurality of bow tines with one end attached to one end of a first bow mount. There may be a second bow mount with one end removably attached the opposing end of the first bow mount and its opposing end pivotably attached to the opposing end of the shaft clip. There may be a plurality of teeth formed by notches in the opposing end of the first bow mount and the end of the second bow mount. A screw may threadedly connect the first bow mount to the second bow mount. The screwdriver may be adapted to fit the screw. The fork tines may be curved forward in shape and have their opposing end taper to a point. There may be a plurality of limbs with one end removably inserted into the limb holders. The rear leg may comprise a hollow outer leg with one end pivotably connected to the hinge bracket and an inner leg with one end inserted into the opposing end of the outer leg and its opposing end attached to the middle of the rear leg support. There may be a plurality of adjustment holes in the sidewall of the outer leg and the sidewall of the inner leg. A locking pin may have one end removably inserted through the adjustment holes. The end of the locking pin may have a cotter pin hole in it. There may be a cotter pin removably inserted through the cotter pin hole. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, there fore, that the claims be regarded as including such equivalent constructions insofar as they do not depart from the spirit and scope of the present invention.

It is therefore an object of the present invention to provide a new and improved adjustable bow stand that has all of the advantages of the prior art adjustable stands for archery bows and none of the disadvantages.

It is another object of the present invention to provide a new and improved adjustable bow stand that nay be easily and efficiently manufactured and marketed.

An ever further object of the present invention is to provide a new and improved adjustable bow stand that has a low cost of manufacture with regard to both materials and labor, and which accordingly is then susceptible of low prices of sale to the consuming public, thereby making such adjustable bow stand economically available to the buying public.

Still another object of the present invention is to provide a new adjustable bow stand that provides in the apparatuses and methods of the prior art some of the advantages thereof, while simultaneously overcoming some of the disadvantages normally associated therewith.

Even still another object of the present invention is to provide an adjustable bow stand for providing a hunter with cover and easy access to his or her weapon. This allows the user to conceal their silhouette and movements.

Still yet another object of the present invention is to provide an adjustable bow stand for providing a hunter with cover and easy access to his or her weapon. This makes it possible to hunt in open areas where the absence of trees makes tree stand hunting impossible.

An additional object of the present invention is to provide an adjustable bow stand for providing a hurter with cover and easy access to his or her weapon. This allows the hunter to adjust the bow holder to the desired angle.

A further object of the present invention is to provide an adjustable bow stand for providing a hunter with cover and easy access to his or her weapon. This allows the hunter to retrieve and draw a bow with minimal movement.

Lastly, it is an object of the present invention to provide a new and improved adjustable bow stand for providing a hunter with cover and easy access to his or her weapon.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
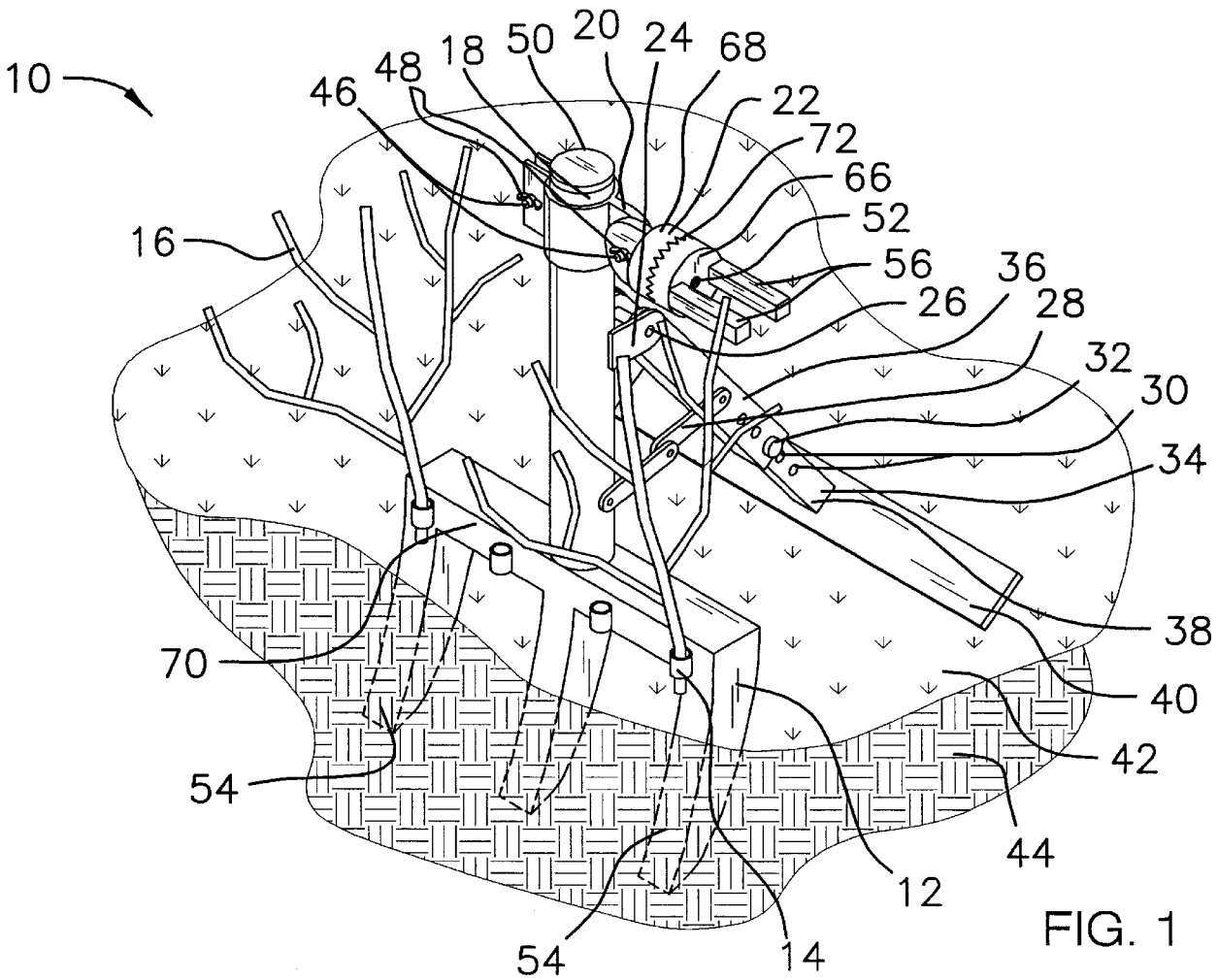
FIG. 1 is a top perspective view of the current embodiment of the adjustable bow stand constructed in accordance with the principles of the present invention.

Referring now to the drawings, and particularly to FIGS. 1–6, a current embodiment of the adjustable bow stand of the present invention is,shown and generally designated by the reference numeral 10.

In FIG. 1, a new and improved adjustable bow stand 10 of the present invention for providing a hurter with cover and easy access to his or her weapon is illustrated and will be described. More particularly, the adjustable bow stand 10 has a shaft 18 with a fork 12 attached to one end and a shaft clip 20 attached to its opposing end. The adjustable bow stand 10 is shown ready for use with the fork tines 54 attached to the fork head 70 of fork 12 driven underground 44. Limbs 16 have one end removably inserted into the limb holders 14 attached to the front of the fork 12. The limbs 16 serve to conceal the silhouette and movements of a hunter (not shown). The shaft 18 is supported in an upright position not only by fork 12, but also by rear leg 34 with rear leg support 40 attached to one end and resting upon the ground surface 42. The opposing end of rear leg 34 is hingedly attached by hinge bracket 24 and hinge pin 26 to the middle of shaft 18. The middle of the rear leg 34 is attached by the opposing ends of the folding brace 28 to the middle of shaft 18. The length of the rear leg 34 can be adjusted by removing locking pin 32 from adjustment holes 30, sliding inner leg 38 within outer leg 36 to align a new set of adjustment holes 30, and then replacing the locking pin 32 to retain the adjustment. The shaft clip 20 is removably secured in place to the opposing end of shaft 18 by a bolt 46 with a threadedly attached wing nut 48. A bow holder 22 is pivotably attached to the opposing end of the shaft clip 20 by a bolt 46 with threadedly attached wing nut 48. The bow holder 22 has a plurality of bow tines 56 with one end attached to one end of first bow mount 66. First bow mount 66 is removably attached by screw 52 to one end of second bow mount 68. The opposing end of the first bow mount 66 and the end of the second bow mount 68 have notches in them to form teeth 72. The teeth 72 removably secure first bow mount 66 in place with respect to second bow mount 68. A cap 50 removably covers the opposing end of the shaft 18. In the current embodiment, the adjustable bow stand 10 is made of aluminum, and the limbs 16 are artificial tree limbs. The fork tines 54 are curved forward in shape, taper to a point, and are about six inches in length, and the fork head 70 is about twelve inches in width, in the current embodiment.

Figure 2:
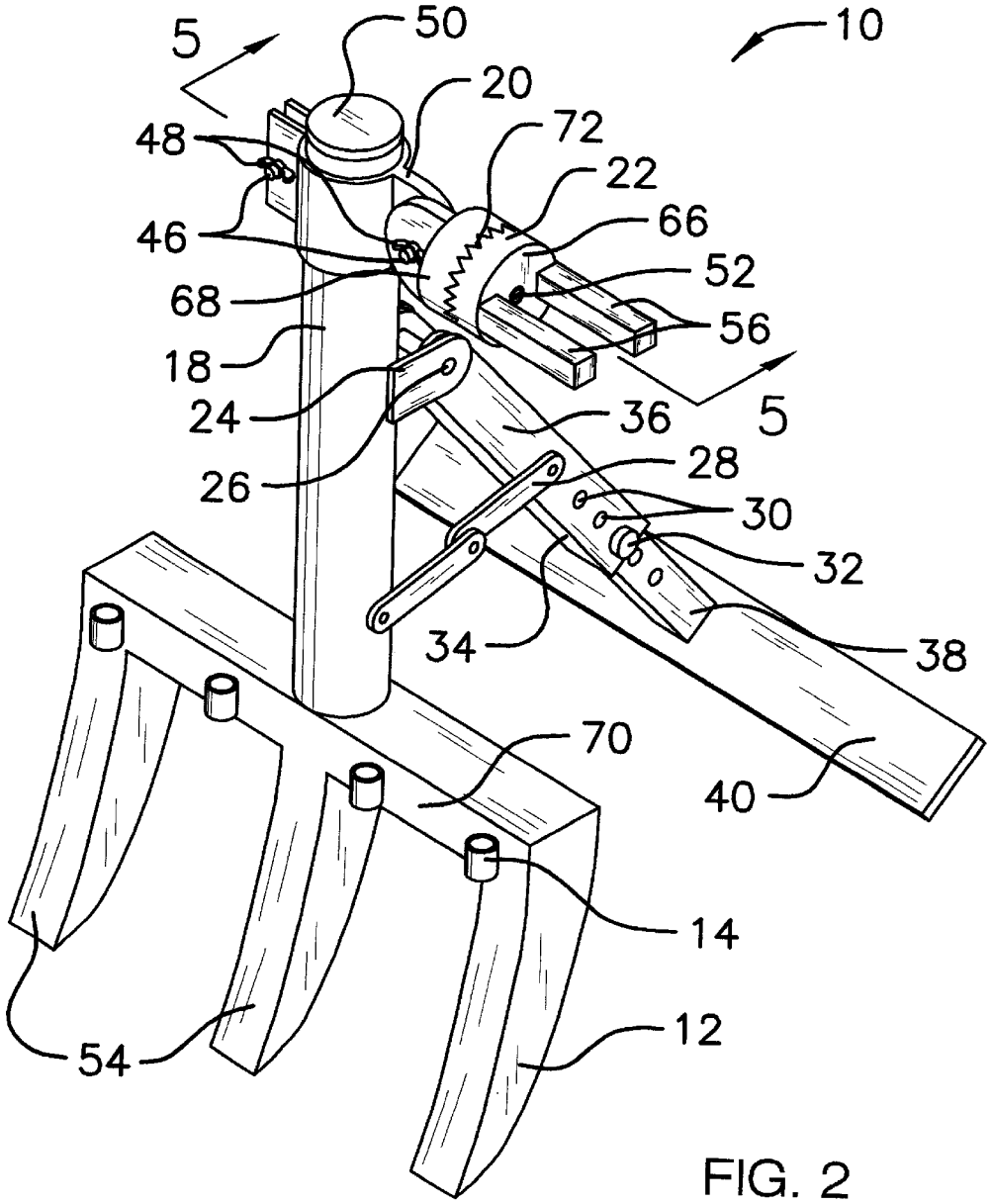
FIG. 2 is a top perspective view of the adjustable bow stand of the present invention.

Moving on to FIG. 2, a new and improved adjustable bow stand 10 of the present invention for providing a hunter with cover and easy access to his or her weapon is illustrated and will be described. More particularly, the adjustable bow stand 10 has a cap 50 removably covering one end of shaft 18. A shaft clip 20 is also removably attached by a bolt 46 and wing nut 48 inserted through one end to one end of the shaft 18. A fork 12 with a fork head 70 and fork tines 54 is attached to the opposing end of the shaft 18. The limb holders 14 are attached by their sidewall to the front of the fork head 70 portion of the fork 12. The middle of the shaft 18 has one end of a hinge bracket 24 and one end of a folding brace 28 attached to it. The outer leg 36 portion of the rear leg 34 is attached to the opposing ends of the hinge bracket 24 and folding brace 28. A hinge pin 26 hingedly attaches one end of the outer leg 36 to the hinge bracket 24. One end of the inner leg 38 portion of the rear leg 34 has the middle of a rear leg support 40 attached to it. The adjustment holes 30 in the sidewall of the outer leg 36 and inner leg 38, along with locking pin 32, allow the length of the rear leg 34 to be adjusted. A bow holder 22 is pivotably attached by a bolt 46 and wing nut 48 to the opposing end of the shaft clip 20. The bow holder 22 comprises a first bow mount 66 with bow tines 56 adapted to fit a compound bow removably attached by a screw 52 to a second bow mount 68. The teeth 72 present on one end of the first bow mount 66 and second bow mount 68 intermesh to maintain the relative position of the first bow mount 66 and second bow mount 68. The removably attached nature of the shaft clip 20 allows the height of the bow holder 22 to be adjusted by the user.

Figure 3:
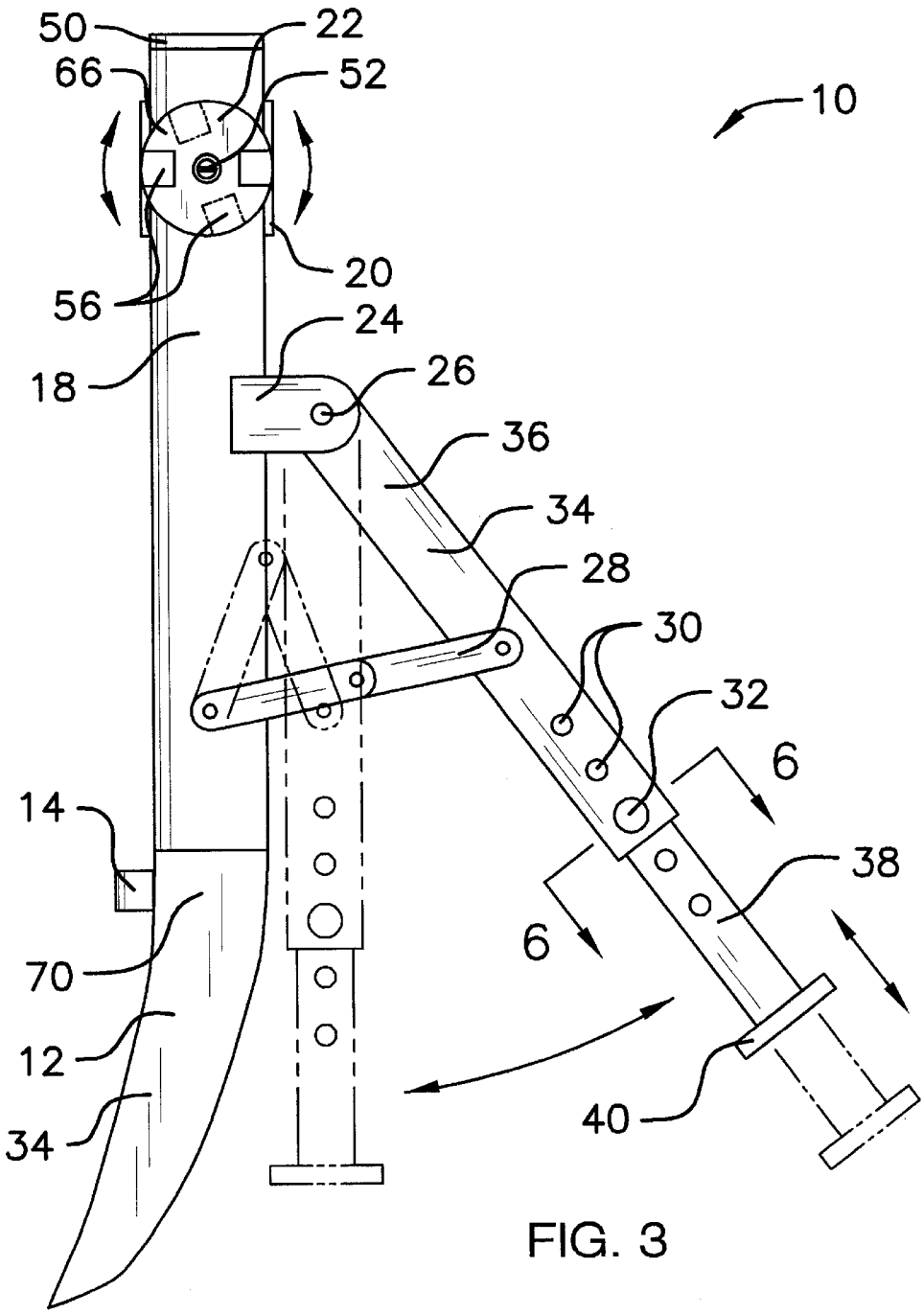
FIG. 3 is a side view of the adjustable bow stand of the present invention.

Continuing with FIG. 3, a new and improved adjustable bow stand 10 of the present invention for providing a hunter with cover and easy access to his or her weapon is illustrated and will be described. More particularly, the adjustable bow stand 10 has a shaft 18 with a shaft clip 20 removably attached to one end and the fork head 70 portion of a fork 12 attached to its opposing end. A fork tine 34 has its top attached to the bottom of the fork head 70, and a limb holder 14 is attached to the front of the fork head 70. The hingedly attached nature of the rear leg 34 to hinge bracket 24 by hinge pin 26 and the folding nature of the folding brace 28 allow the rear leg 34 to be collapsed against the shaft 18 when the adjustable bow stand 10 is not in use. Furthermore, the adjustment holes 30 and locking pin 32 present in the sidewall of the inner leg 38 and outer leg 36 portion of the rear leg 34 allow the length of the outer leg 36 to be adjusted. A rear leg support 40 attached to one end of the inner leg 38 provides additional support for the adjustable bow stand 10 when it is in use. The angle of the bow holder 22 and bow tines 56 can be adjusted by unscrewing screw 52 so that the first bow mount 66 can have its teeth 72 (not shown) disengaged from the teeth 72 of the second bow mount 68 (not shown) so that the first bow mount 66 can be rotated into a new position with respect to the second bow mount 68. Screw 52 is then tightened to maintain the adjustment of the angle of the bow holder 22.

Figure 4:
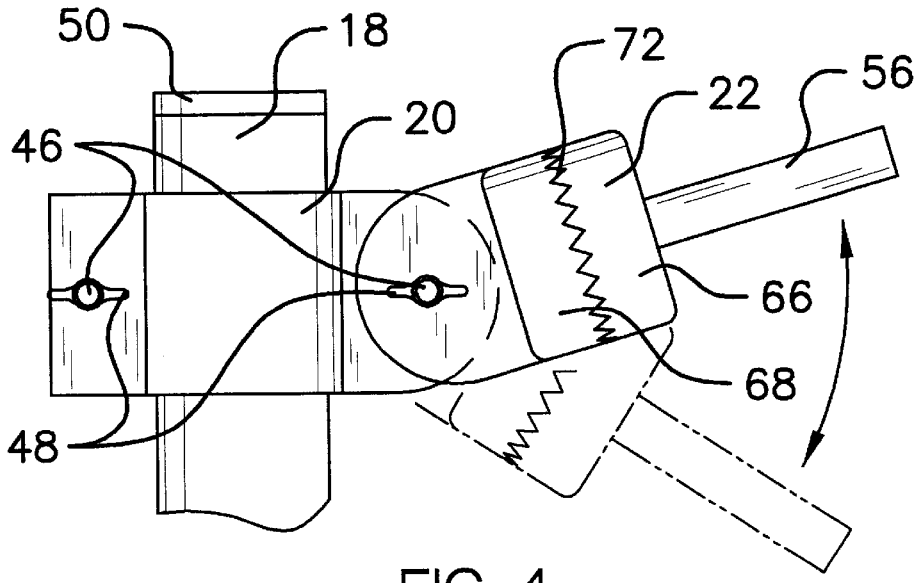
FIG. 4 is a side view of the bow holder of the present invention.

In FIG. 4, a new and improved bow holder 22 of the present invention for providing a hunter with cover and easy access to his or her weapon is illustrated and will be described. More particularly, the bow holder 22 has a second bow mount 68 with one end pivotably attached to one end of a shaft clip 20 by a bolt 46 and wing nut 48. When the wing nut 48 is loosened, the bow holder 22 with teeth 72, first bow mount 66, second bow mount 68, and bow tines 56 can be pivoted about the bolt 46 to adjust the angle of the bow holder 22. To maintain the adjustment, the wing nut 48 is then tightened. The height of the bow holder 22 can be adjusted by loosening the wing nut 48 attached to the bolt 46 passing through the opposing end of the shaft clip 20 so that the shaft clip 20 can be slid up or down the shaft 18. The wing nut 48 is then tightened to secure the adjustment of the shaft clip 20. The cap 50 removably covers one end of the shaft 18.

Figure 5:
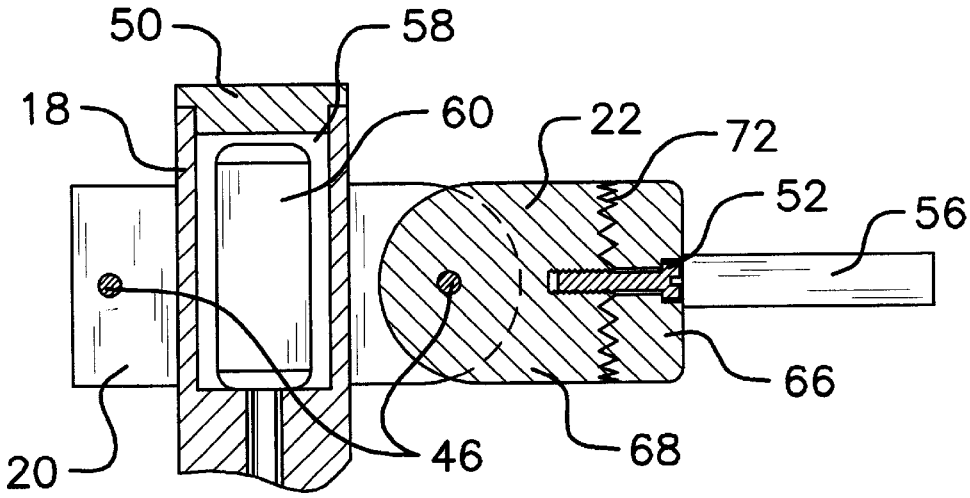
FIG. 5 is a side sectional view of the bow holder of the present invention.

Furthermore, in FIG. 5, a new and improved bow holder 22 of the present invention for providing a hunter with cover and easy access to his or her weapon is illustrated and will be described. More particularly, the bow holder 22 has a bolt 46 attaching one end of the second bow mount 68 to one end of the shaft clip 20. Another bolt 46 removably attaches the shaft clip 20 to one end of the shaft 18. A screwdriver compartment 58 is present in the end of the shaft 18, where it removably encloses a screwdriver 60. A cap 50 keeps the screwdriver 60 in place within the screwdriver compartment 58 when the screwdriver 60 is not in use. The screwdriver 60 is adapted to fit a screw 52 so that screw 52 can be loosened or tightened. Screw 52 secures one end of first bow mount 66 against the opposing end of the second bow mount 68, causing teeth 72 to intermesh. One end of bow tines 56 is attached to the opposing end of the first bow mount 66.

Figure 6:
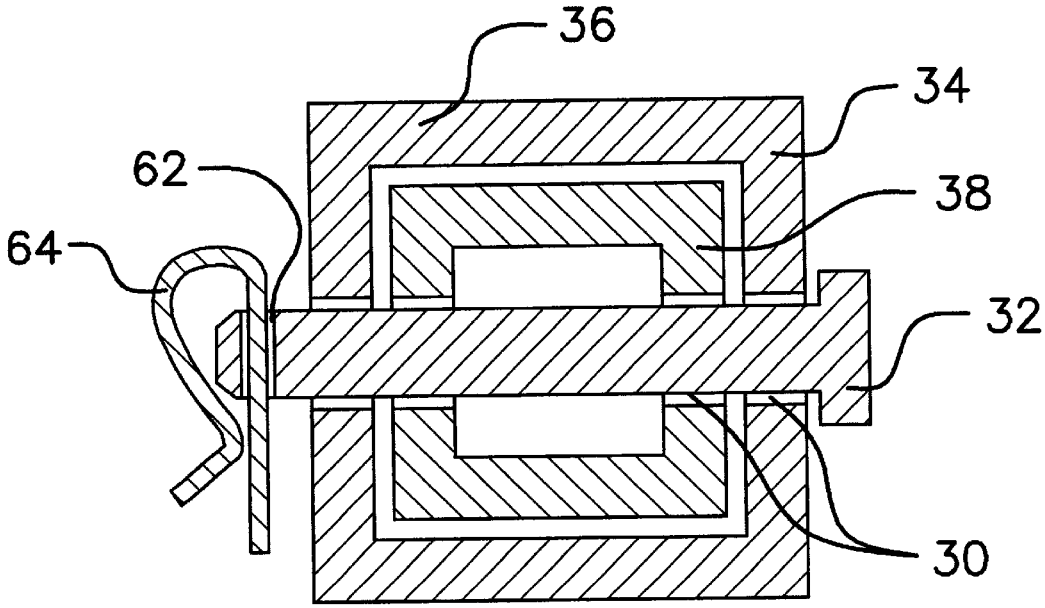
FIG. 6 is a top sectional view of the rear leg of the present invention.

Concluding with FIG. 6, a new and improved rear leg 34 of the present invention for providing a hunter with cover and easy access to his or her weapon is illustrated and will be described. More particularly, the rear leg 34 has an inner leg 38 with one end inserted into one end of an outer leg 36. A locking pin 32 removably inserted through an aligned set of adjustment holes 30 removably secures the relative positions of the outer leg 36 and inner leg 38. A cotter pin 64 removably inserted through the cotter pin hole 62 in one end of the locking pin 32 removably secures the locking pin 32 in place.

In use, it can now be understood that the user carries the adjustable bow stand 10 into the wilderness and uses it to construct a ground blind in the spot where he or she wishes to hunt. The hunter unfolds the adjustable bow stand 10 by pivoting the rear leg 34 about the hinge bracket 24 and unfolding the folding brace 28. The hunter than pushes the fork tines 54 into the ground surface 42, adjusts the length of the rear leg 34 by removing locking pin 32, sliding inner leg 38, and replacing locking pin 32, and then slides real or artificial limbs 16 into the limb holders 14 on the front of the fork 12. The user can use screwdriver 60 to unscrew screw 52 so that the first bow mount 66 can be adjusted. The user can also unscrew the wing nuts 48 to adjust the height of the shaft clip 20 and to pivot the bow holder 22. The hunter then places his or her bow between the bow tines 56 of the bow holder 22. When a game animal approaches, the hunter removes his or her bow from the bow tines 56 and raises it into shooting position. At the conclusion of the hunt, the user collapses the rear leg 34 and removes the fork tines 54 from the underground 44. The hunter then folds the adjustable bow stand 10 for transport by pivoting the rear leg 34 about the hinge bracket 24 and folding the folding brace 28.

While a current embodiment of the adjustable bow stand has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic, steel, titanium, wood, or carbon fiber composite may be used instead of the aluminum adjustable bow stand described. Also, the artificial tree limb may also be a real tree limb. And although providing a hunter with cover and easy access to his or her weapon has been described, it should be appreciated that the adjustable bow stand herein described is also suitable for holding a variety of weapons in addition to compound bows. Furthermore, a wide variety of fork tine shapes may be used instead of the forwardly curved, tapered to a point fork tine shape described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable bow stand comprising:

a fork having a front, a top, and a bottom;

a shaft having opposing ends and a middle with one end attached to said top of said fork;

a shaft clip having opposing ends that are removably attached to said opposing end of said shaft;

a bow holder having opposing ends with one end hingedly attached to one of said ends of said shaft clip;

a hinge bracket having opposing ends with one end-connected to said middle of said shaft;

a hinge pin inserted through said opposing end of said hinge bracket;

a rear leg having opposing ends and a middle with one end connected to said opposing end of said hinge bracket by said hinge pin; and a folding brace having opposing ends with one end connected to said middle of said shaft and said opposing end connected to said middle of said rear leg.

2. The adjustable bow stand as defined in claim 1, further comprising a limb holder attached to said front of said fork.

3. The adjustable bow stand as defined in claim 1, further comprising:

a screwdriver compartment wherein said opposing end of said shaft defines a hole therein to comprise said screwdriver compartment;

a cap removably covering said opposing end of said shaft and said screwdriver compartment; and a screwdriver removably inserted into said screwdriver compartment.

4. The adjustable bow stand as defined in claim 1, further comprising a rear leg support having a middle with said middle attached to said opposing end of said rear leg.

5. The adjustable bow stand as defined in claim 1, wherein said rear leg is telescoping in nature.

6. The adjustable bow stand as defined in claim 1, wherein said bottom of said fork is adapted to be driven into the ground.

7. The adjustable bow stand as defined in claim 1, wherein said bow holder is adapted to fit a compound bow.

8. The adjustable bow stand as defined in claim 1, wherein said adjustable bow stand is selected from the group consisting of plastic, steel, aluminum, titanium, wood, and carbon fiber composite.

9. The adjustable bow stand as defined in claim 2, further comprising a limb having opposing ends with one end removably inserted into said limb holder.

10. The adjustable bow stand as defined in claim 9, wherein said limb is an artificial tree limb.

11. An adjustable bow stand comprising:

a shaft having opposing ends and a middle;

a fork head having a top, a bottom, and a front with said top attached to said end of said shaft;

a plurality of fork tines having opposing ends with one end attached to said bottom of said fork head;

a plurality of limb holders having a sidewall with said sidewall attached to said front of said fork head;

a shaft clip having opposing ends and a middle with said middle removably attached to said opposing end of said shaft;

a bolt having opposing ends with one end inserted through one end of said shaft clip;

a wing nut threadedly attached to said end of said bolt;

a bow holder having opposing ends with one end pivotably attached to said opposing end of said shaft clip;

a second bolt having opposing ends with one end inserted through said opposing end of said shaft clip and said end of said bow holder;

a wing nut threadedly attached to said end of said second bolt;

a hinge bracket having opposing ends with one end connected to said middle of said shaft;

a rear leg having opposing ends and a middle with one end connected to said opposing end of said hinge bracket;

a hinge pin connecting said opposing end of said hinge bracket to said end of said rear leg;

a folding brace having opposing ends with one end connected to said middle of said shaft and said opposing end connected to said middle of said rear leg; and a rear leg support having a middle with said middle attached to said opposing end of said rear leg.

12. The adjustable bow stand as defined in claim 11, wherein said bow holder comprises:

a plurality of bow tines having opposing ends;

a first bow mount having opposing ends with one end attached to said end of said bow tines;

a second bow mount having opposing ends with one end removably attached to said opposing end of said first bow mount and said opposing end pivotably attached to said opposing end of said shaft clip;

a plurality of teeth wherein said opposing end of said first bow mount and said end of said second bow mount defined notches therein to comprise said teeth; and a screw threadedly connecting said first bow mount to said second bow mount.

13. The adjustable bow stand as defined in claim 12, further comprising:

a screwdriver compartment wherein said opposing end of said shaft defines a hole therein to comprise said screwdriver compartment;

a cap removably covering said opposing end of said shaft and said screwdriver compartment; and a screwdriver removably inserted into said screwdriver compartment.

14. The adjustable bow stand as defined in claim 13, wherein said screwdriver is adapted to fit said screw.

15. The adjustable bow stand as defined in claim 11, wherein said fork tines are curved forward in shape and said opposing end of said fork tines tapers to a point.

16. The adjustable bow stand as defined in claim 11, further comprising a plurality of limbs having opposing ends with one end removably inserted into said limb holders.

17. An adjustable bow stand comprising:

a rear leg support having a middle;

a telescoping rear leg having opposing ends and a middle with one end attached to said middle of said rear leg support;

a hinge bracket having opposing ends with one end pivotably connected to said opposing end of said rear leg;

a folding brace having opposing ends with one end connected to said middle of said rear leg;

a shaft having opposing ends and a middle with said middle of said shaft attached to said opposing end of said hinge bracket and said opposing end of said folding brace;

a fork having a top, a bottom, and a front with said top attached to said end of said shaft;

a shaft clip having opposing ends attached to said opposing end of said shaft;

a bow holder pivotably attached to one of said ends of said shaft clip; and a limb holder attached to said front of said fork.

18. The adjustable bow stand as defined in claim 17, wherein said rear leg comprises:

a hollow outer leg having opposing ends and a sidewall with one end pivotably connected to said hinge bracket;

an inner leg having opposing ends and a sidewall with one end inserted into said opposing end of said outer leg and said opposing end attached to said middle of said rear leg support;

a plurality of adjustment holes wherein said sidewall of said outer leg and said sidewall of said inner leg define holes therein to comprise said adjustment holes;

a locking pin having opposing ends with one end removably inserted through said adjustment holes;

a cotter pin hole wherein said end of said locking pin defines a hole therein to comprise said cotter pin hole; and a cotter pin removably inserted through said cotter pin hole.

19. The adjustable bow stand as defined in claim 18, further comprising:

a screwdriver compartment wherein said opposing end of said shaft defines a hole therein to comprise said screwdriver compartment;

a cap removably covering said opposing end of said shaft and said screwdriver compartment; and a screwdriver removably inserted into said screwdriver compartment.

20. The adjustable bow stand as defined in claim 19, further comprising a limb having opposing ends with one end removably inserted into said limb holder.

* * * * *